US011319658B2

(12) United States Patent
Lv et al.

(10) Patent No.: US 11,319,658 B2
(45) Date of Patent: May 3, 2022

(54) DRUM WASHING MACHINE

(71) Applicant: QINGDAO HAIER DRUM WASHING MACHINE CO., LTD., Shandong (CN)

(72) Inventors: Peishi Lv, Shandong (CN); Sheng Xu, Shandong (CN); Chunfeng Lao, Shandong (CN); Yanfen Lv, Shandong (CN); Yimin Li, Shandong (CN)

(73) Assignee: QINGDAO HAIER DRUM WASHING MACHINE CO., LTD., Shandong (CN)

( * ) Notice: Subject to any disclaimer, the term of this patent is extended or adjusted under 35 U.S.C. 154(b) by 109 days.

(21) Appl. No.: 16/611,989

(22) PCT Filed: May 8, 2018

(86) PCT No.: PCT/CN2018/086036
§ 371 (c)(1),
(2) Date: Nov. 8, 2019

(87) PCT Pub. No.: WO2018/205934
PCT Pub. Date: Nov. 15, 2018

(65) Prior Publication Data

US 2021/0131006 A1 May 6, 2021

(30) Foreign Application Priority Data

May 9, 2017 (CN) ..... 201710320265.3

(51) Int. Cl.
*D06F 39/08* (2006.01)
*D06F 21/04* (2006.01)
*D06F 37/22* (2006.01)

(52) U.S. Cl.
CPC ..... *D06F 39/083* (2013.01); *D06F 21/04* (2013.01); *D06F 39/088* (2013.01); *D06F 37/22* (2013.01)

(58) Field of Classification Search
CPC ..... D06F 21/04; D06F 37/22; D06F 39/083; D06F 39/088
See application file for complete search history.

(56) References Cited

U.S. PATENT DOCUMENTS 4,941,333 A 7/1990 Blessing
2011/0099727 A1* 5/2011 Kim ..... D06F 34/18 8/137
2015/0176176 A1 6/2015 Kim et al.

FOREIGN PATENT DOCUMENTS

CN 104727074 A 6/2015
CN 104727077 A 6/2015
(Continued)

OTHER PUBLICATIONS

International Search Report (with English Translation) and Written Opinion issued in corresponding International Patent Application No. PCT/CN2018/086036, 9 pages (dated Aug. 1, 2018).
(Continued)

*Primary Examiner* — Michael E Barr
*Assistant Examiner* — Pallavi Chitta
(74) *Attorney, Agent, or Firm* — Buchanan Ingersoll & Rooney PC

(57) ABSTRACT

A drum washing machine comprises an inner drum rotatable. Both ends of the inner drum are closed and rotatably mounted on a supporting device through rotating shafts, respectively. A side wall of the inner drum is provided with an input port for taking and putting items. A sealing inner cover capable of being opened/closed is mounted at the input port. A water flow passage for feeding water and/or draining water is arranged in at least one of the rotating
(Continued)

shafts at both ends of the inner drum. The whole inner drum may be made into a drum without any hole. During the washing process, washing water is held in the inner drum, and the inner drum rotates to wash clothes. The two closed ends of the inner drum are rotatably mounted on the supporting device through the rotating shafts, thus realizing rotation of the inner drum.

13 Claims, 3 Drawing Sheets

(56) References Cited

FOREIGN PATENT DOCUMENTS

| | | | | | |
|---|---|---|---|---|---|
| CN | 105951348 | A | * | 9/2016 | |
| CN | 106381634 | A | | 2/2017 | |
| CN | 106381635 | A | | 2/2017 | |
| CN | 106436137 | A | | 2/2017 | |
| CN | 106436143 | A | | 2/2017 | |
| CN | 106544829 | A | | 3/2017 | |
| CN | 105951346 | A | | 4/2018 | |
| DE | 1610118 | A1 | | 4/1971 | |
| DE | 2824114 | A1 | | 12/1979 | |
| DE | 4229074 | A1 | | 3/1994 | |
| EP | 0381423 | A1 | | 8/1990 | |
| EP | 2889422 | A1 | * | 7/2015 | ..... D06F 39/088 |
| GB | 1469023 | A | | 3/1977 | |
| JP | H04297298 | A | | 10/1992 | |
| JP | H07-100293 | A | | 4/1995 | |

OTHER PUBLICATIONS

Notice of Reasons for Refusal issued by the Japanese Patent Office in corresponding Japanese Patent Application No. 2019-561724 dated Jul. 13, 2021 (10 pages including partial English translation).

Jieshi: "Graphic washing machine maintenance technology," Jinfu Publishing House, Jan. 2017 (7 pages including partial English translation).

* cited by examiner

DRUM WASHING MACHINE

TECHNICAL FIELD

The present disclosure relates to the technical field of clothes washing equipment, and more particularly relates to a drum washing machine.

BACKGROUND

In the prior art, a drum washing machine generally comprises an inner drum and an outer drum which are sleeved, the outer drum is sealed and used for containing water, and the inner drum is used for containing clothes and can rotate to beat and wash the clothes. Meanwhile, the inner drum is provided with draining holes, so that water in the outer drum flows into the inner drum through the draining holes to soak the clothes in the inner drum, the water in the inner drum flows out to the outer drum through the draining holes, and water in the clothes in the inner drum is discharged to the outer drum through the draining holes when the inner drum rotates at a high speed, so as to realize the purpose of washing clothes.

However, as the inner drum and the outer drum are mutually sleeved, dirt tends to be accumulated between the inner drum and the outer drum during the use of the washing machine. Besides, because the inner and outer drums are mutually sleeved, users cannot clean the outer wall of the inner drum and the inner wall of the outer drum, thus increasing bacteria in the washing machine and reducing the washing efficiency of the washing machine and the cleanliness of the washed clothes.

Meanwhile, in the existing washing machines, the inner drum is sleeved with the outer drum, the inner drum rotates to beat and wash clothes in the washing process, so the washing capacity of the washing machine is based on the inner drum, resulting in a low utilization rate of the inner space of the washing machine, and the washing capacity of the washing machine cannot be expanded on the existing basis.

In view of this, the current research and development hotspot is to provide a washing machine to combine the inner and outer drum and make the inner drum be a sealed container, which can not only contain water and clothes, but also rotate to beat and wash the clothes. Meanwhile, since the washing machine is not provided with an outer drum or the outer drum and a housing of the washing machine are integrally arranged, the inner drum of the washing machine can be expanded to improve the washing capacity of the washing machine.

However, since the inner drum not only contains washing water, but also rotates to beat and wash clothes in the drum, how to design a feeding structure and/or draining structure suitable for the washing machine has become an urgent problem to be solved.

In view of the above technical defects, the present application is hereby submitted.

SUMMARY

In order to solve the above problem, the present disclosure provides a drum washing machine. Specifically, the following technical solution is adopted.

A drum washing machine includes an inner drum rotatable. Two ends of the drum are closed and rotatably mounted on a supporting device through rotating shafts, respectively. A side wall of the inner drum is provided with an input port for taking and putting items. A sealing inner cover capable of being opened/closed is mounted at the input port. A water flow passage for feeding water and/or draining water is arranged in at least one of the rotating shafts at the two ends of the drum.

Further, the drum washing machine further includes a driving device. One end of the inner drum acts as a rear drum bottom. The rear drum bottom is connected with the driving device through a center rotating shaft in a transmission way. The center rotating shaft is internally hollow to allow the water flow passage to be arranged therein.

One water flow passage is arranged in the center rotating shaft, and is communicated with a water feeding device or a drainage device of the drum washing machine.

Or, water flow passages are arranged in the center rotating shaft, and the water flow passages are respectively communicated with the water feeding device and the drainage device.

Further, one end of the center rotating shaft extends out of the driving device. The end extending of the center rotating shaft is rotatably mounted on a communicating piece through a bearing. A communicating passage is arranged in the communicating piece, and the communicating passage communicates the water flow passage with the water feeding device/drainage device.

Further, the drainage device includes a drainage pipe and a self-sucking pump. A water inlet of the self-sucking pump is communicated with the water flow passage through the drainage pipe.

An inner wall of the rear drum bottom of the inner drum is provided with a water collection device for collecting water in a dewatering process and/or drainage process, and the water collection device is communicated with the water flow passage.

In the dewatering process and/or drainage process, the water collection device collects the water in the inner drum and drains water under the suction action of the self-sucking pump.

Further, the water collection device comprises a water collection cavity and a water collection passage. The water collection cavity is arranged in a center of the inner wall of the rear drum bottom, and communicated with the water flow passage in the center rotating shaft. The water collection passage is arranged on the inner wall of the rear drum bottom of the inner drum. One end of the water collection passage is communicated with the water collection cavity, and another end of the water collection passage extends towards the inner side wall of the drum.

Preferably, water collection passages are arranged and are uniformly distributed in a circumferential direction of the rear drum bottom of the inner drum.

Further, the water collection device includes a cover plate mounted on the inner wall of the rear drum bottom of the inner drum.

The cover plate is internally provided with a hollow cavity being closed to form the water collection cavity and the water collection passages.

Or, the cover plate is internally provided with a groove with an opening. The cover plate and the inner wall of the rear drum bottom of the inner drum are hermetically connected to close the groove to form the water collection cavity and the water collection passages.

Further, another end of the inner drum opposite to the rear drum bottom acts as a front drum cover. A diameter of the front drum cover is less than a diameter of the rear drum bottom. A side wall of the inner drum is upwards inclined from the front drum cover to the rear drum bottom.

Further, the drum washing machine further includes a machine body and an outer drum arranged coaxially with the inner drum. The outer drum is mounted in the machine body through a vibration absorption device. The inner drum is arranged in the outer drum. The inner drum holds water in a washing process, and no water exists between the inner drum and the outer drum.

Both ends of the outer drum are closed, and an opening is formed in a position, corresponding to the input port, of a top side wall of the outer drum. A sealing outer cover capable of being opened/closed is mounted on the opening. The rotating shafts at the both ends of the inner drum are rotatably mounted on walls of the both ends of the outer drum.

Further, the vibration absorption device includes a damper and a vibration absorption hanging spring. The damper is mounted in a middle of a bottom side wall of the outer drum. The vibration absorption hanging spring is hung on the top side wall of the outer drum.

Preferably, the vibration absorption hanging ring is hung on the top side wall of the outer drum and near to the driving device. And two dampers are symmetrically mounted on two sides of the bottom side wall of the outer drum.

Further, a drainage port is formed in the rear drum bottom of the inner drum. A sealing plug is mounted on the drainage port. A telescopic device is mounted at a position, corresponding to the sealing plug, of a bottom of the outer drum, the telescopic device extends to push the sealing plug apart to enable the drainage port to be opened to drain water. The telescopic device retracts to enable the sealing plug to be reset to close the drainage port.

The front and rear ends of the inner drum of the drum washing machine in the present disclosure are closed, and the input port is formed in the side wall of the inner drum, so that the whole inner drum is made into an inner drum without any hole. During washing, washing water is held in the inner drum, and the inner drum rotates to wash clothes. Therefore, an outer drum of an existing drum washing machine is canceled. In this way, the volume of the inner drum is increased without changing the size of the machine body, thus increasing the capacity of the drum washing machine. In addition, the inner drum holds the water, which solves the problem that the outer wall of the inner drum and the inner wall of the outer drum easily "hide dirt" over time because the washing water of the existing washing machine enters a space between the inner drum and the outer drum.

The two closed ends of the inner drum of the present disclosure are rotatably mounted on the supporting device through the rotating shafts, respectively, which realizes rotation of the inner drum, and the water flow passage for feeding water and/or draining water is arranged in at least one of the rotating shafts at the two ends of the inner drum to realize water feeding and drainage.

NUMERALS IN THE DRAWINGS

1: sealing outer cover; 2: water feeding pipe; 3: vibration absorption hanging spring; 4: machine body; 5: outer drum; 6: water collection passage; 8: driving device; 9: communicating piece; 10: center rotating shaft; 11: water collection cavity; 12: third bearing; 13: self-sucking pump; 14: drainage pipe; 15: eccentric cam; 16: telescopic rod; 17: sealing plug; 18: reset spring; 19: drainage valve; 20: main drainage pipe; 21: water retaining rib; 22: damper; 24: first bearing; 25: supporting body; 26: second bearing; 27: sealing inner cover; 29: water feeding water box; 30: drainage port; 31: fourth bearing; and 32: transmission rotating shaft.

DETAILED DESCRIPTION

A drum washing machine of the present disclosure is described in detail below in conjunction with accompanying drawings.

Figure 1:
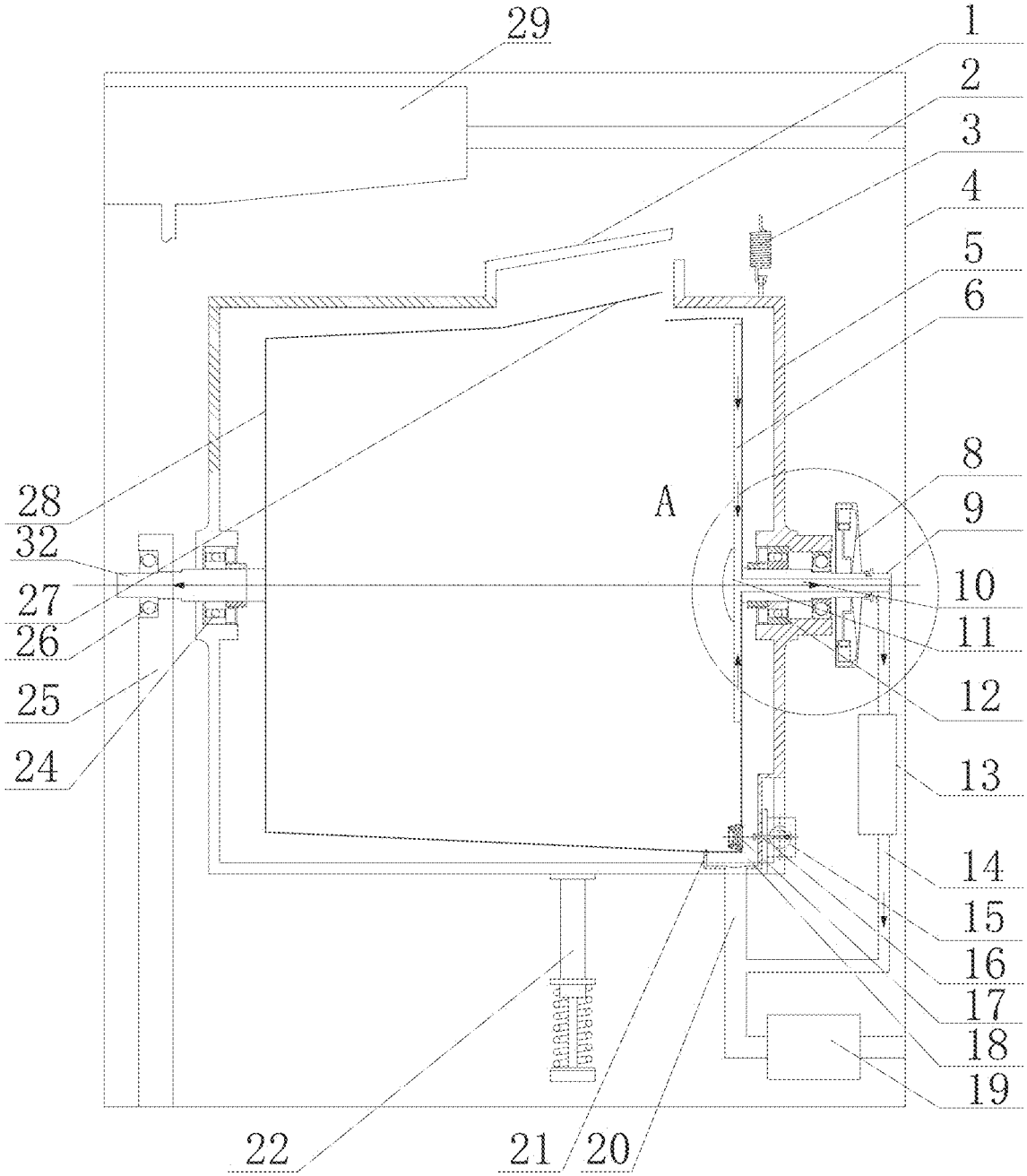
FIG. 1 is a front view of a drum washing machine of an embodiment of the present disclosure.
Figure 2:
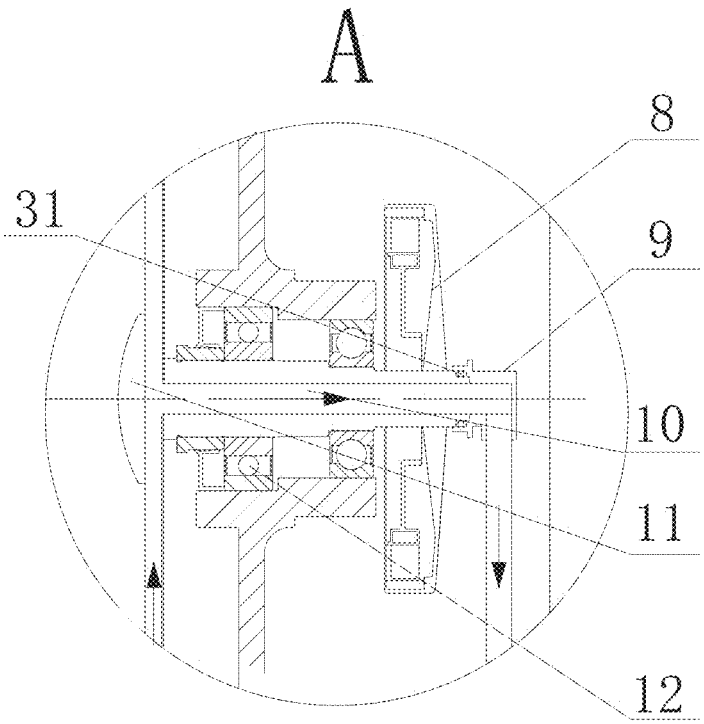
FIG. 2 is a partially enlarged diagram of a portion A of the drum washing machine in FIG. 1 of the embodiment of the present disclosure.
Figure 3:
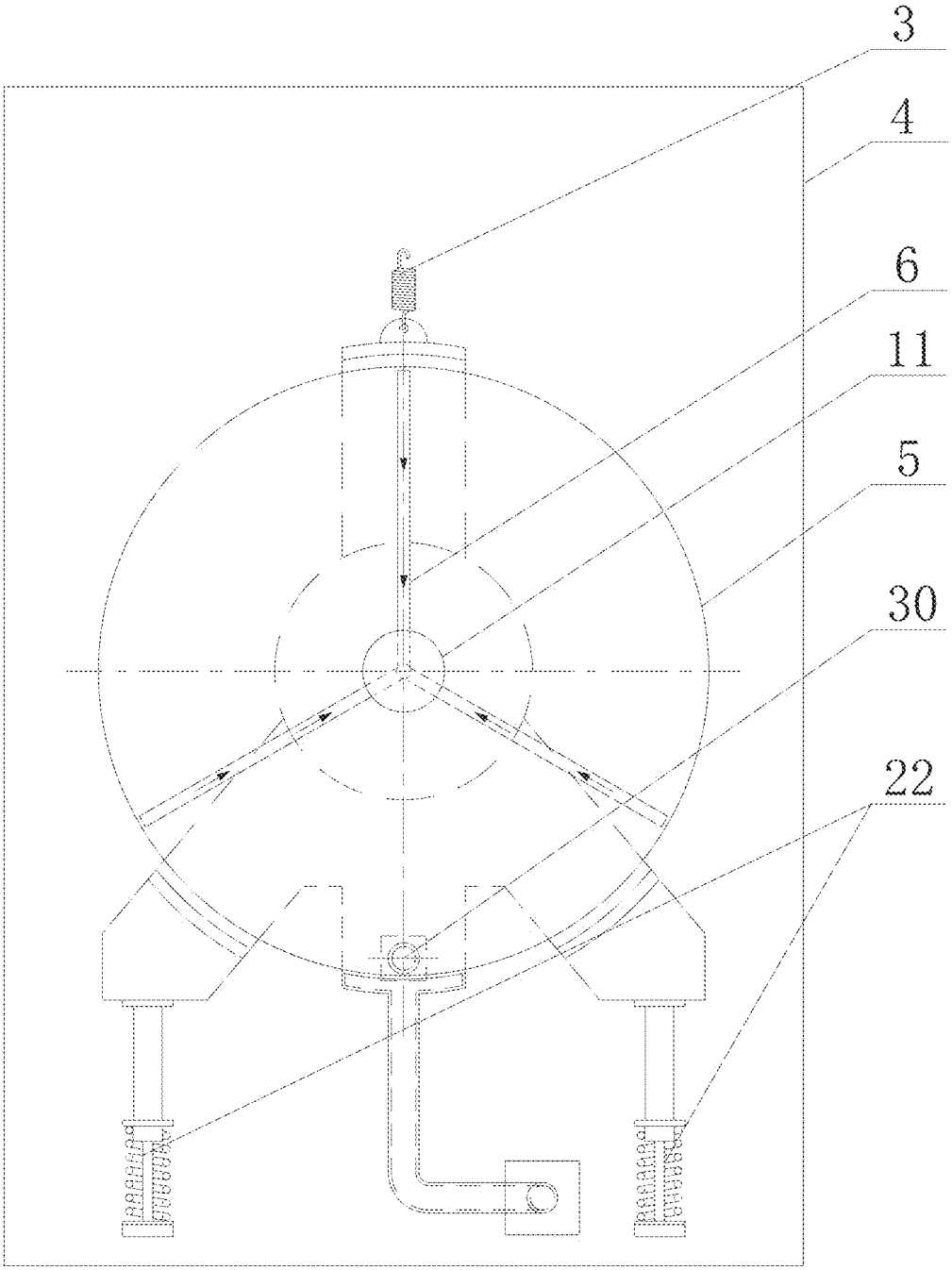
FIG. 3 is a left view of the drum washing machine of the embodiment of the present disclosure.

As shown in FIG. 1 and FIG. 2, a drum washing machine of the present embodiment includes an inner drum 28 rotatable. Two ends of the inner drum 28 are closed and are rotatably mounted on a supporting device through rotating shafts, respectively. An input port for taking and putting clothes is formed in a side wall of the inner drum 28. A sealing inner cover 27 capable of being opened/closed is mounted at the input port. A water flow passage for feeding water and/or draining water is arranged in at least one of the rotating shafts at the two ends of the inner drum 28.

The inner drum 28 in the present embodiment is an inner drum without any dewatering hole in the wall of the inner drum. During washing, washing water is held in the inner drum 28, and the inner drum 28 rotates to wash clothes. The drum washing machine of the present disclosure may not have an outer drum. In this way, the volume of the inner drum 28 is increased without changing the size of the machine body, thus increasing the capacity of the drum washing machine. In addition, the inner drum 28 holds the water, which solves the problem that the outer wall of the inner drum and the inner wall of the outer drum easily "hide dirt" over time because the washing water of the existing washing machine enters a space between the inner drum and the outer drum.

The inner drum 28 of the drum washing machine in the present embodiment rotates by taking a horizontal axis as a center. An input port is formed in the front end of the existing inner drum 28, so that the outer drum is sealed in the existing manner to prevent the washing water from overflowing. The rotating mode of the inner drum 28 of the drum washing machine in the present disclosure is unchanged, but the two ends of the inner drum 28 are closed, and the input port is formed in the side wall of the inner drum 28. In this way, only the input port needs to be sealed, so that the sealing structure is simplified.

The two closed ends of the inner drum of the present embodiment are rotatably mounted on the supporting device through the rotating shafts, respectively, which realizes rotation of the inner drum, and the water flow passage for feeding water and/or draining water is arranged in at least one of the rotating shafts at the two ends of the inner drum 28 to realize water feeding and drainage.

As a preferred implementation mode of the present disclosure, the drum washing machine of the present embodiment further includes a driving device 8. One end of the inner drum 28 acts as a rear drum bottom. The rear drum bottom is connected with the driving device 8 through a center rotating shaft 10 in a transmission way. The center rotating shaft 10 is internally hollow to allow the water flow passage to be arranged therein. In the present embodiment, the water flow passage is arranged in the center rotating shaft 10, in this way, the washing machine can feed water through the water flow passage or drain through the water flow passage, and the rotation of the drum may not affect the water feeding and drainage.

Preferably, one water flow passage is arranged in the center rotating shaft 10, and is communicated with a water feeding device or a drainage device of the drum washing machine. The water flow passage in the center rotating shaft 10 of the present embodiment may only realize an independent water feeding function or an independent drainage function.

Or, a plurality of water flow passages are arranged in the center rotating shaft 10, and water flow passages are respectively communicated with the water feeding device and the drainage device in the present embodiment. In this way, the water flow passages in the center rotating shaft 10 may simultaneously realize water feeding and drainage.

As a preferred implementation mode of the present disclosure, one end of the center rotating shaft 10 extends out of the driving device 8. The end extending of the center rotating shaft 10 is rotatably mounted on a communicating piece 9 through a bearing. A communicating passage is arranged in the communicating piece 9, and the communicating passage communicates the water flow passage with the water feeding device/drainage device.

The present disclosure will elaborate by taking drainage through the water flow passage in the center rotating shaft 10 as an example. The water flow passage in the center rotating shaft 10 of the present embodiment is communicated with the drainage device to realize the drainage function. Specifically, the drainage device of the present embodiment includes a drainage pipe 14 and a self-sucking pump 13. A water inlet of the self-sucking pump 13 is communicated with the water flow passage in the center rotating shaft 10 through the drainage pipe 14.

Since the center rotating shaft 10 is located at the center position of the rear drum bottom of the inner drum, instead of the lowest position of the inner drum, in order to ensure that the washing water in the drum is drained better, the inner wall of the rear drum bottom of the inner drum 28 is provided with a water collection device for collecting water in a dewatering and/or drainage process, and the water collection device is communicated with the water flow passage. In the dewatering and/or drainage process, the water collection device collects the water in the drum and drains the water under the suction action of the self-sucking pump 13.

Specifically, the water collection device in the present embodiment comprises a water collection cavity 11 and a water collection passage 6. The water collection cavity 11 is arranged in the center of the inner wall of the rear drum bottom of the inner drum 28, and is communicated with the water flow passage in the center rotating shaft 10. The water collection passage 6 is arranged on the inner wall of the rear drum bottom of the inner drum. One end of the water collection passages 6 is communicated with the water collection cavity 11, and another end of the water collection passage 6 extends towards the inner wall of the inner drum 28.

Preferably, a plurality of water collection passages 6 are arranged and are uniformly distributed along the circumferential direction of the rear drum bottom of the inner drum 28.

In order to cooperate with the water collection device to collect water, the end, opposite to the rear drum bottom, of the inner drum 28 of the present embodiment acts as a front drum cover. The diameter of the front drum cover is less than the diameter of the rear drum bottom. The side wall of the inner drum 28 is upwards inclined from the front drum cover to the rear drum bottom.

In order to achieve a water collection effect of the water collection device, rotation of the inner drum 28 is also needed. When the inner drum 28 rotates, the washing water is gathered on the surface of the side wall of the inner drum 28 under the centrifugal action. Due to the inclined structure of the side wall, the washing water is gathered from the front drum cover to the rear drum bottom along the inclined side wall of the inner drum 28 and guided into the water collection cavity through the water collection passages 6 arranged here.

Therefore, during the dehydration process of the drum washing machine of the present embodiment, water collection and drainage is realized by the high-speed rotation of the drum 28. A drainage procedure may be added after the washing process. The drainage is realized by accelerating the high-speed rotation of the drum 28.

As a preferred implementation mode of the present embodiment, the water collection device of the present embodiment includes a cover plate mounted on the inner wall of the rear drum bottom of the inner drum. The cover plate is internally provided with a hollow cavity being closed to form the water collection cavity 11 and the water collection passages 6. Or, the cover plate is internally provided with a groove with an opening. The cover plate and the inner wall of the rear drum bottom of the inner drum are hermetically connected to close the groove to form the water collection cavity 11 and the water collection passages 6.

As a preferred implementation mode of the present embodiment, a protruding structure protruding from the inner bottom of the inner drum is arranged on the upper surface of the water collection device. The protruding structure may lift washings during washing, so as to enhance washing effect.

The drum washing machine of the present embodiment further includes a machine body 4 and an outer drum 5 arranged coaxially with the inner drum 28. The outer drum 5 is mounted in the machine body 4 through a vibration absorption device. The inner drum 28 is arranged inside the outer drum 5. The inner drum 28 holds water in a washing process, and no water exists between the inner drum 28 and the outer drum 5. Both ends of the outer drum 5 are closed, and an opening is formed in a position, corresponding to the input port, of the top side wall of the outer drum 5. A sealing outer cover 1 capable of being opened/closed is mounted on the opening. The rotating shafts at the both ends of the inner drum 28 are rotatably mounted on the outer drum walls of the both ends of the outer drum 5.

The outer drum 5 in the present embodiment is not used to hold water in the washing process, but mainly used to realize vibration absorption of the inner drum 28 through the vibration absorption device, so as to ensure the stability of operation of the drum washing machine.

Further, the vibration absorption device in the present embodiment includes a damper 22 and a vibration absorption hanging spring 3. The damper 22 is mounted in the middle of the bottom side wall of the outer drum 5. The vibration absorption hanging spring 3 is hung on the top side wall of the outer drum 5.

Preferably, the vibration absorption hanging ring 3 is hung on the top side wall of the outer drum and near to the driving device. And two dampers 22 are symmetrically mounted on two sides of the bottom side wall of the outer drum 5.

As a preferred implementation mode of the present embodiment, since the drainage of the center rotating shaft 10 is realized by cooperation with the high-speed rotation of the inner drum 28, a corresponding drainage structure is arranged for the drainage in the washing process on the basis of arrangement of the outer drum 5.

Specifically, a drainage port 30 is formed in the rear drum bottom of the inner drum 28 of the present embodiment. A sealing plug 17 is mounted on the drainage port 30. A telescopic device is mounted at a position, corresponding to the sealing plug 17, of a bottom of the outer drum, and may extend out to push the sealing plug 17 apart to enable the drainage port 30 to be opened to drain water. The telescopic device retracts to enable the sealing plug 17 to be reset to close the drainage port 30.

Therefore, the drainage of the drum washing machine of the present embodiment in the washing process may be realized by controlling the telescopic device to open the drainage port 30. The water may be drained through the water flow passage inside the center rotating shaft 10 in the dewatering process.

Further, a reset spring 18 connected with the sealing plug 17 is also arranged in the drainage port 30 of the present embodiment. When the telescopic device retracts, the sealing plug 17 is reset under the elastic action of the reset spring 18.

The telescopic device of the present embodiment includes an eccentric cam 15 driven by a motor to rotate, and a telescopic rod 16 rotatably connected with the eccentric cam 15. The eccentric cam 15 rotates to drive the telescopic rod 16 to move upwards, so as to eject the sealing plug 17 to open the drainage port 30 to drain water.

An outer drum drainage port is arranged at a position, corresponding to the drainage port 30 of the inner drum, of the outer drum 5 in the present embodiment, and is connected with a main drainage pipe 20. A water retaining rib 21 is arranged on one side of the outer drum drainage port, and retains the washing water between the water retaining rib 21 and the bottom of the outer drum, so as to prevent much washing water from being in contact with the inner surface of the outer drum 5 and prevent dirt from being accumulated on the inner wall of the outer drum 5.

The drainage pipe 14 in the present embodiment is communicated with the main drainage pipe 20, and the main drainage pipe 20 is connected with a drainage valve 19.

In the drum washing machine of the present embodiment, the rotating shaft at the front end of the inner drum 28 penetrates through the front end of the outer drum 5, and is rotatably mounted on a supporting body 25, and the rotating shaft at the rear end of the inner drum 28 penetrates through the rear end of the outer drum 5, and is in transmission connection with the driving device 8.

The front end of the inner drum 28 of the present embodiment is fixedly connected with a transmission rotating shaft 32. The transmission rotating shaft 32 penetrates through the front end of the outer drum 5. A first bearing 24 is arranged between the transmission rotating shaft 32 and the front end of the outer drum. A second bearing 26 is arranged between the first rotating shaft 32 and the supporting body 25. A third bearing 12 is arranged at the rear ends of the center rotating shaft 10 and the outer drum 5. A fourth bearing 31 is arranged between the center rotating shaft 10 and the communicating piece 9.

A water feeding water box 29 and a water feeding pipe 2 connected with the water feeding water box 29 are also arranged in the drum washing machine of the present embodiment. When water enters from the water flow passage in the center rotating shaft 10, the water feeding pipe 2 communicates with the water flow passage in the center rotating shaft 10.

The above descriptions are only preferred embodiments of the present disclosure, but not intended to limit the present disclosure in any forms. Although the present disclosure is disclosed above by the preferred embodiments, the preferred embodiments are not intended to limit the present disclosure. Any person skilled in the art can make some changes by using the above-mentioned technical contents or modify the technical contents as equivalent embodiments of equivalent changes without departing from the scope of the technical solution of the present disclosure. Any simple alterations, equivalent changes and modifications that are made to the above embodiments according to the technical essence of the present disclosure without departing from the contents of the technical solution of the present disclosure shall all fall within the scope of the solution of the present disclosure.

The invention claimed is:

1. A drum washing machine, comprising:

an inner drum configured to rotate and including two ends, wherein the ends of the inner drum are closed and rotatably mounted on a supporting device through rotatable shafts, respectively, a side wall of the inner drum includes an input port for inserting and removing items;

a sealing inner cover configured to be opened/closed is mounted at the input port; and a water flow passage for feeding water and/or draining water is arranged in at least one of the rotatable shafts at the ends of the inner drum; wherein one end of the inner drum is a rear drum bottom, the rear drum bottom is connected with a driving device for driving the rotatable shafts through a center rotating shaft, the center rotating shaft is internally hollow to form the water flow passage, an inner wall of the rear drum bottom of the inner drum includes a water collection device for collecting water in a dewatering process and/or drainage process, and the water collection device communicates with the water flow passage, the water collection device includes a water collection cavity and a water collection passage, the water collection cavity is arranged in a center of the inner wall of the rear drum bottom, and communicates with the water flow passage in the center rotating shaft, the water collection passage is arranged on the inner wall of the rear drum bottom of the inner drum, one end of the water collection passage communicates with the water collection cavity, and another end of the water collection passage extends towards an inner wall of the inner drum.

2. The drum washing machine according to claim 1, wherein one water flow passage is arranged in the center rotating shaft that communicates with a device for draining water of the drum washing machine.

3. The drum washing machine according to claim 2, wherein a first end of the center rotating shaft extends out of the driving device for driving the rotating shafts through a bearing, the first end of the center rotating shaft is rotatably mounted on a communicating piece for connecting and allowing water to flow through, and a communicating passage is arranged in the communicating piece, and the communicating passage communicates the water flow passage with the device for draining water.

4. The drum washing machine according to claim 2, wherein the device for draining water comprises a drainage pipe and a pump; and a water inlet of the pump communicates with the water flow passage through the drainage pipe;

in the dewatering process and/or drainage process, the water collection device is configured to collect the water in the inner drum and drains water under the suction action of the pump.

5. The drum washing machine according to claim 1, wherein the water collection device comprises a cover plate mounted on the inner wall of the rear drum bottom of the inner drum, the cover plate is internally provided with a cavity being closed to form the water collection cavity and the water collection passages.

6. The drum washing machine according to claim 2, wherein another end of the inner drum opposite to the rear drum bottom acts as a front drum cover, a diameter of the front drum cover is less than a diameter of the rear drum bottom, and a side wall of the inner drum is inclined from the front drum cover to the rear drum bottom in a direction away from a central axis of the inner drum.

7. The drum washing machine according to claim 1, comprising:

a machine body; and an outer drum arranged coaxially with the inner drum, wherein the outer drum is mounted in the machine body through a device for absorbing vibration, the inner drum is arranged in the outer drum, the inner drum holds water in a washing process, and no water exists between the inner drum and the outer drum, wherein both ends of the outer drum are closed, and an opening is formed in a position, corresponding to the input port, of a top side wall of the outer drum, a sealing outer cover configured to be opened/closed is mounted on the opening, and the rotating shafts at the both ends of the inner drum are rotatably mounted on walls of the both ends of the outer drum.

8. The drum washing machine according to claim 7, wherein the device for absorbing vibration comprises a damper and a vibration absorption hanging spring, the damper is mounted in a middle of a bottom side wall of the outer drum, and the vibration absorption hanging spring is hung on the top side wall of the outer drum.

9. The drum washing machine according to claim 7, comprising:

a drainage port formed in the rear drum bottom of the inner drum;

a sealing plug is mounted on the drainage port; and a telescopic device for driving the sealing plug to move is mounted at a position, corresponding to the sealing plug, of a bottom of the outer drum, the telescopic device is configured to extend to push the sealing plug apart to enable the drainage port to be opened to drain water, and the telescopic device is configured to retract to enable the sealing plug to be reset to close the drainage port.

10. The drum washing machine according to claim 3, wherein the device for draining water comprises a drainage pipe and a pump, a water inlet of the pump communicates with the water flow passage through the drainage pipe, an inner wall of the rear drum bottom of the inner drum is provided with a water collection device for collecting water in a dewatering process and/or drainage process, and the water collection device communicates with the water flow passage; and in the dewatering process and/or drainage process, the water collection device collects the water in the inner drum and drains water under the suction action of the pump.

11. The drum washing machine according to claim 4, comprising a plurality of water collection passages arranged and uniformly distributed in a circumferential direction of the rear drum bottom of the inner drum.

12. The drum washing machine according to claim 8, wherein the vibration absorption hanging ring is hung on the top side wall of the outer drum and near to the driving device for driving the rotating shafts and two dampers are symmetrically mounted on two sides of the bottom side wall of the outer drum.

13. The drum washing machine according to claim 1, wherein the water collection device comprises a cover plate mounted on the inner wall of the rear drum bottom of the inner drum, the cover plate is internally provided with a groove with an opening, the cover plate and the inner wall of the rear drum bottom of the inner drum are hermetically connected to close the groove to form the water collection cavity and the water collection passages.

* * * * *